US005946998A

United States Patent [19]

Thompson

[11] Patent Number: 5,946,998

[45] **Date of Patent: *Sep. 7, 1999**

[54] BAGEL, ROLL, AND BUN HOLDER DEVICE

[75] Inventor: Stephen M. Thompson, 10710 Esther Ave., Los Angeles, Calif. 90064

[73] Assignee: Stephen M. Thompson, Los Angeles, Calif.

[ * ] Notice: This patent is subject to a terminal disclaimer.

[21] Appl. No.: 08/525,285

[22] Filed: Sep. 8, 1995

[51] Int. Cl.[6] ..... B26D 3/30; B26D 7/01

[52] U.S. Cl. ..... 83/870; 83/454; 83/465; 83/762; 83/932; 269/87.2; 269/270; 269/288

[58] Field of Search ..... 83/454, 455, 462, 83/465, 466.1, 761, 762, 763, 764, 765, 870, 932, 17, 19, 13; 269/87.2, 268, 270, 288, 290, 291, 292, 295; D7/673, 674

[56] References Cited

U.S. PATENT DOCUMENTS

| | | | |
|---|---|---|---|
| D. 160,864 | 11/1950 | Kaplowitz et al. | D7/674 X |
| D. 377,297 | 1/1997 | Thompson | D7/673 |
| 1,098,941 | 6/1914 | Collins | 83/762 |
| 2,206,154 | 7/1940 | Bixler | 83/762 |
| 2,429,756 | 10/1947 | Hartmann | 83/762 |
| 2,477,493 | 7/1949 | Olson | 83/761 |
| 2,679,274 | 5/1954 | Criner | 83/762 |
| 3,347,296 | 10/1967 | Rothman | 269/87.2 |
| 4,249,445 | 2/1981 | Browning | 83/762 |
| 4,253,650 | 3/1981 | Kuzio | 269/87.2 |
| 4,399,989 | 8/1983 | Baillie | 269/87.2 |
| 4,546,686 | 10/1985 | Losiowski et al. | 83/874 |
| 4,550,636 | 11/1985 | Josselson et al. | 83/762 X |
| 4,747,331 | 5/1988 | Policella | 83/762 |
| 4,807,505 | 2/1989 | Campbell et al. | 83/454 |
| 4,807,892 | 2/1989 | Popeil et al. | 269/87.2 |
| 4,948,106 | 8/1990 | Popeil et al. | 269/87.2 |
| 5,228,668 | 7/1993 | Guyer | 269/87.2 |
| 5,361,666 | 11/1994 | Kensrue | 83/762 X |

OTHER PUBLICATIONS

HFD—Retailing Home Furnishings, Housewares, Jul. 10, 1978, p. 72, Bagel/Bun Holder.

*Primary Examiner*—Clark F. Dexter
*Attorney, Agent, or Firm*—Oppenheimer Wolff & Donnelly LLP

[57] ABSTRACT

A bagel, roll, and bun holder device for holding a bagel, roll, bun or other similar object which provides a safe and stable device for slicing the bagel, roll, bun or other similar object with a hand-held knife is provided. The bagel, roll, and bun holder device comprises a base element and a first and a second holding element. The base element has a first and second edge. The first and second holding elements each have a marginal side edge, each have an inside surface and an outside surface, each have a stop element on their inside surface, and each have a frictional element on their outside surface. The first holding element is pivotally attached to the first edge of the base element at its marginal side edge. The second holding element is pivotally attached to the second edge of the base element at its marginal side edge. The first and second holding elements are pivotally movable from an opened position to a closed position.

15 Claims, 5 Drawing Sheets

FIG. 2
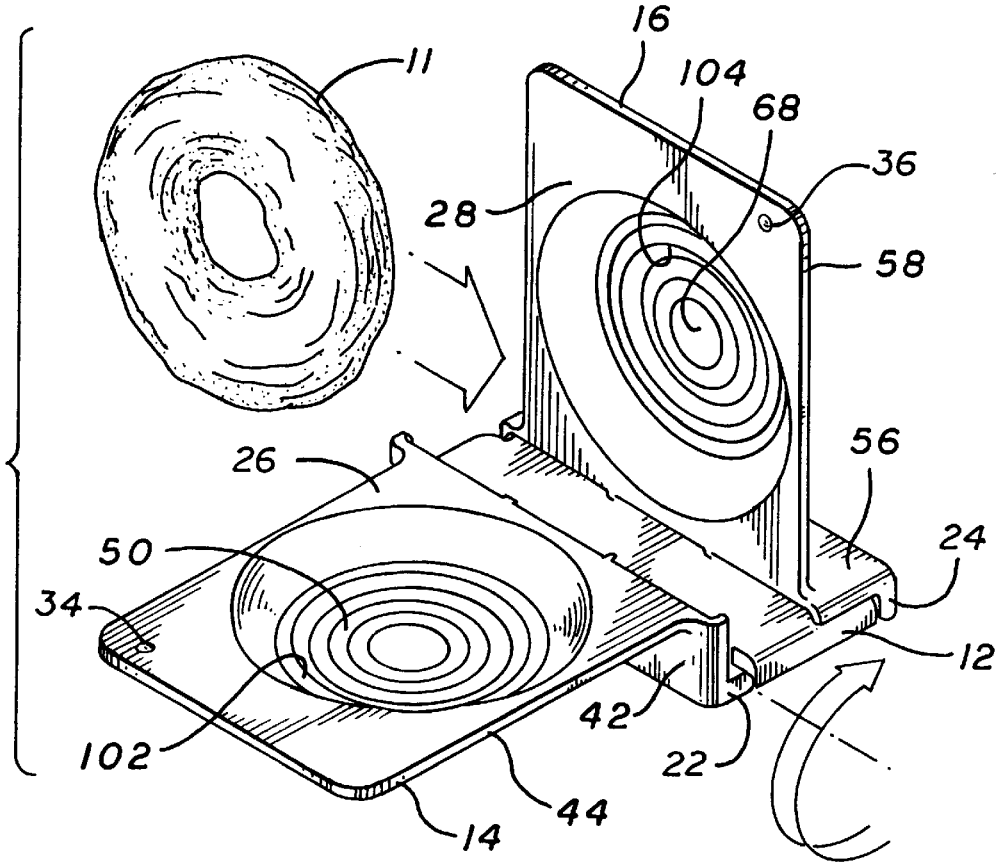
FIG. 4
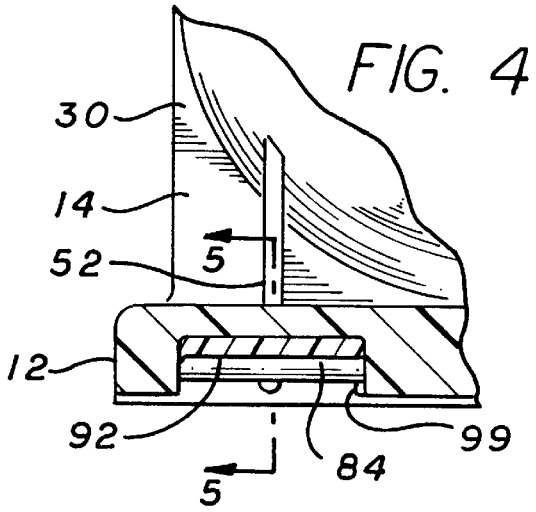
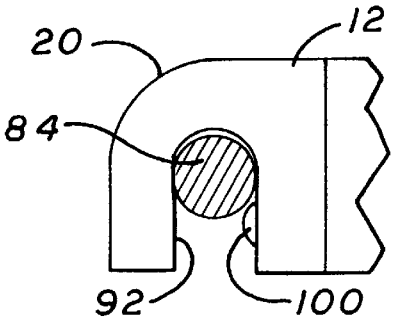
FIG. 5

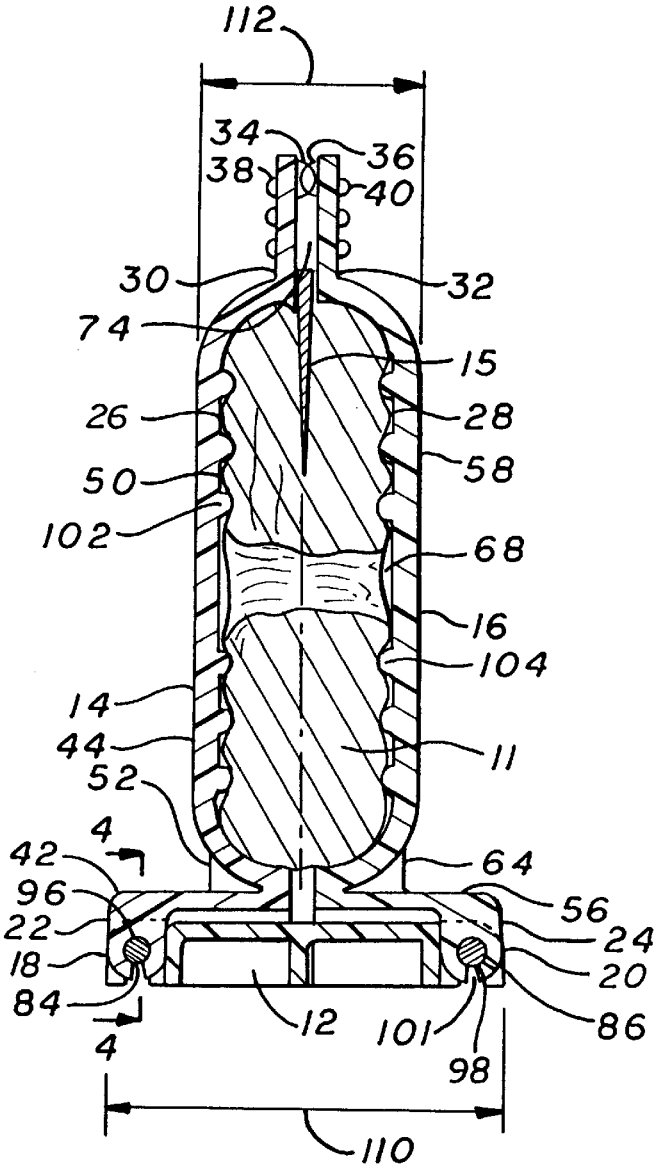
FIG. 3
FIG. 6
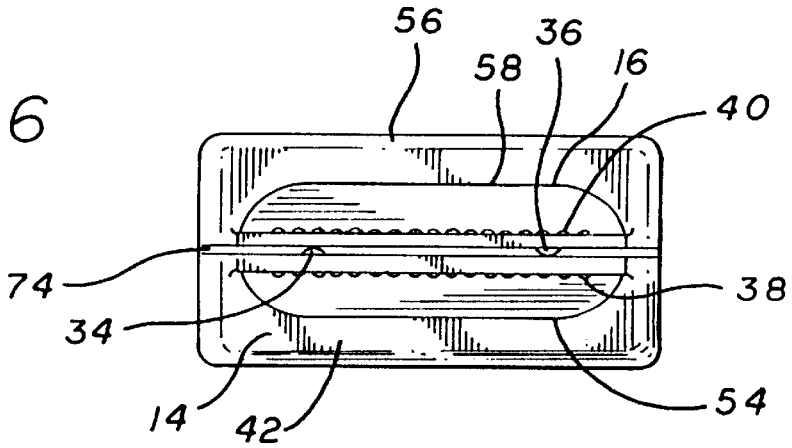

BAGEL, ROLL, AND BUN HOLDER DEVICE

FIELD OF THE INVENTION

The present invention relates in general to bagel, roll, and bun holding devices. In particular, the present invention relates to bagel, roll, and bun holding devices for holding a bagel, roll, bun, or other similar object which provides a safe and stable means for slicing the bagel, roll, bun or other similar object with a hand-held knife.

BACKGROUND OF THE INVENTION

Bagels, rolls, and buns that are baked from a bread or other dough substance come in many shapes and sizes. Regardless of their shape or size, bagels, rolls, and buns are most often eaten by slicing the bagel, roll, or bun in half. By slicing the bagel, roll, or bun in half, the user can place a meat, cheese, vegetable or other substance between the two slices to form a sandwich. The user can also spread items such as butter, cream cheese or jam onto the opened portion of the bagel, roll, or bun. Further, by slicing the bagel, roll, or bun, the user can toast its exposed interior in a toaster oven or in a conventional toaster.

Slicing a bagel, roll, bun or other similar object, however, can be a frustrating and often dangerous task. Bagels, rolls, and buns are usually formed having a width that is much greater than their height. Most bagels, rolls, and buns are also formed of a consistency having a hard crust and a softer interior. This great width coupled with the hard consistency spells trouble for the user who desires to slice the bagel along its width with a hand-held knife. The user has to hold the bagel in one hand while slicing the bagel with a large knife in the other hand. The user has to be careful when starting the cut so that the knife does not deflect off the hard surface of the bagel and cut the hand that holds the bagel. Because the slice is being made along the width, it is very difficult for the user to stabilize the bagel with one hand. The user's ability to stabilize the bagel is further compromised by the fact that user is attempting to slice the bagel along its entire width with a knife that is usually larger than the width of the bagel. Thus, the user's ability to stabilize the bagel is compromised by the fact that the user is continually trying to avoid cutting his stabilizing hand with a knife that is trying to cut the bagel along its entire width. The result is that the user may be unable to stabilize the bagel adequately to be able to make a slice that is straight and down-the-middle or even worse that the user may inadvertently cut his stabilizing hand or fingers with the knife.

Bagel, roll, and bun holding devices that are known are adequate for their intended purpose, but can be improved. For instance, some known bagel, roll, and bun holding devices are too bulky to be easily placed in a dishwashing machine. Further, some known bagel, roll, and bun holding devices can not stand on their own on a countertop or tabletop and thus are too unstable for bagel holding and slicing. Many of these devices allow the user to cradle the bagel, roll or bun in the palm of the user's stabilizing hand and cut the bagel in half with the possibility of cutting the user's stabilizing hand.

Accordingly, a principle object of the present invention is to provide a bagel, roll, and bun holder device that provides a safe and stable means for slicing a bagel, roll, bun or other similar object.

Another object of the present invention is to provide a device that requires the stabilizing hand of the user to be above the knife and hold the device to avoid being cut.

Another object of the present invention to provide a bagel, roll, and bun holder device that is stabilized by being self-standing on a horizontal surface.

Another object of the present invention is to provide a means for holding a bagel, roll, and bun that also provides a means for guiding a knife through the middle portion of the bagel, roll, and bun.

Another object of the present invention is to provide a bagel, roll, and bun holder device that is formed from plastic.

Another object of the present invention to provide a bagel, roll, and bun holder device that opens to a relatively thin and flat shape so as to permit easy placement within a dishwasher machine without disassembly of the device.

Another object of the present invention is to provide a bagel, roll, and bun holder device that can be used by both right-handed and left-handed people.

Another object of the present invention is to provide a bagel, roll, and bun holder device that can also slice fruit, vegetables, or any other item that can fit within the device.

Another object of the present invention is to provide a bagel, roll, and bun holder device that can slice items into thirds or other portions.

Another object of the present invention is to provide a bagel, roll, and bun holder device that is lightweight, portable, easily manufactured, inexpensive, simply designed and rugged.

It will be appreciated from the foregoing that there is a definite need for a bagel, roll, and bun holder device that provides the above objectives. The present invention fulfills these needs.

SUMMARY OF THE INVENTION

In accordance with the present invention, a bagel, roll, and bun holder device is provided which is a safe and stable means for slicing a bagel, roll, bun or other similar object, which is stabilized by being self-standing on a horizontal surface and which opens to a relatively thin and flat shape so as to permit easy placement within a dishwasher machine without disassembly of the device. The foregoing objectives are achieved through a base clement and a first and second holding element. The base element preferably has a first and second edge. The first and second holding elements each have a marginal side edge, an inside and outside surface, a stop element on their inside surface, and a frictional element on their outside surface. The first holding element is pivotally attached to the first edge of the base element at the marginal side edge of the first holding element. The second holding element is pivotally attached to the second edge of the base element at the marginal side edge of the second holding element. The first and second holding elements are pivotally movable from an opened position to a closed position.

The bagel, roll, and bun holder device obtains its desirable characteristics from the design of the base element and the first and second holding elements and from the configuration of the holding elements being pivotally attached to the base element.

The first and second holding elements each have an inside surface that forms a depression. The depression on each holding element is preferably sized to fit approximately one half of an average sized bagel, roll, bun or other item, but may be made larger or smaller depending on its intended use. In one preferred embodiment, the inside surface of the holding elements has at least one rib element located within the depression. The rib element engages the bagel, roll, bun, or other item and holds it stationary within the bagel, roll, and bun holding device.

The first and second holding elements each preferably include a stop element on their inside surface. When the first and second holding elements are in their closed position, the stop element of the first holding element contacts the inside surface of the second holding element and the stop element of the second holding element contacts the inside surface of the first holding element. The stop elements therefore prevent the inside surfaces of the first and second holding elements from contacting and thus permits a slot to be formed between the first and second holding elements.

The distance between the first and second edges of the base element is greater than the largest distance between the outside surfaces of the first and second holding elements when the first and second holding elements are in their closed position. The fact that the base is wider than the first and second holding elements in their closed position permits the bagel, roll, and bun holder device to be self-standing on a horizontal surface such as a tabletop or countertop. Thus, the bagel, roll, and bun holder device, being free-standing, is stable when the bagel, roll, bun, or other item is placed within the first and second holding devices and when the user is slicing the bagel, roll, or bun. Because the first and second holding elements are pivotally attached to the base element, the user can place a bagel, roll, bun, or other item between the first and second holding elements when the holding elements are in their opened position. The first and second holding elements can then be pivoted from their opened position to their closed position. A rib on the base element maintains the holding elements in their closed position. The user may overcome this rib by placing a slight force on the holding elements to move them towards their opened position. This rib also provides enough friction to maintain the holding elements in their opened position. The user may also overcome this friction by applying a slight force on the holding elements to move them towards their closed position.

The user preferably places a bagel, roll, bun or other item within the depression of the holding elements and pivots the holding elements to their near closed position. The user holds the first and second holding elements in their near closed position by placing the fingers of one hand on the frictional elements that are located on the outside surface of the first and second holding elements. The user can then place a knife within the slot between the first and second holding elements, then bring the first and second holding elements to their closed position to thereby center the knife. Because the base element is wider than the first and second holding elements, the user has to place the base element on a tabletop or countertop while slicing to provide further stability thereby preventing the possibility of cutting a hand or finger. The user then slices the bagel, roll, bun or other item that is being held within the depressions of the first and second holding elements while the device is stabilized on its base element on the countertop. Further, the blade of the knife will not slice through the base element, because the base element has a thick center web that would prevent the user from slicing through the center of the base element. The user then removes his fingers from the frictional elements and pivots the first and second holding elements to their opened position to remove the sliced bagel, roll, bun, or other item.

Other objects, features, and advantages of the invention will become apparent from a consideration of the following detailed description and from the accompanying drawings.

BRIEF DESCRIPTION OF THE DRAWINGS

FIG. 2 is a front elevation view showing the inside surface of the holding elements and showing a bagel being placed within the depressions of the holding elements;

FIG. 3 is a cross-sectional view taken along the line 3—3 in FIG. 1 showing a bagel within the depressions of the holding elements and a knife slicing the bagel through its center;

FIG. 4 is a partial side view and partial cross-sectional view taken along the line 4—4 of FIG. 3 showing a mounting clement and a supporting beam of the holding element;

FIG. 5 is a partial cross-sectional view taken along the line 5—5 of FIG. 4 showing the detent of a base element journal sleeve;

FIG. 6 is a top plan view of the bagel, roll, and bun holder device wherein the holding elements are in their closed position;

DETAILED DESCRIPTION OF THE PREFERRED EMBODIMENTS

The present invention is embodied in a bagel, roll, and bun holder device having a base element and having first and second holding elements. The bagel, roll, and bun holder device provides a safe and stable means for slicing a bagel, roll, bun or other similar object, is stabilized by being self-standing on a horizontal surface and opens to a relatively thin and flat shape so as to permit easy placement within a dishwasher machine without disassembly of the device.

Figure 1:
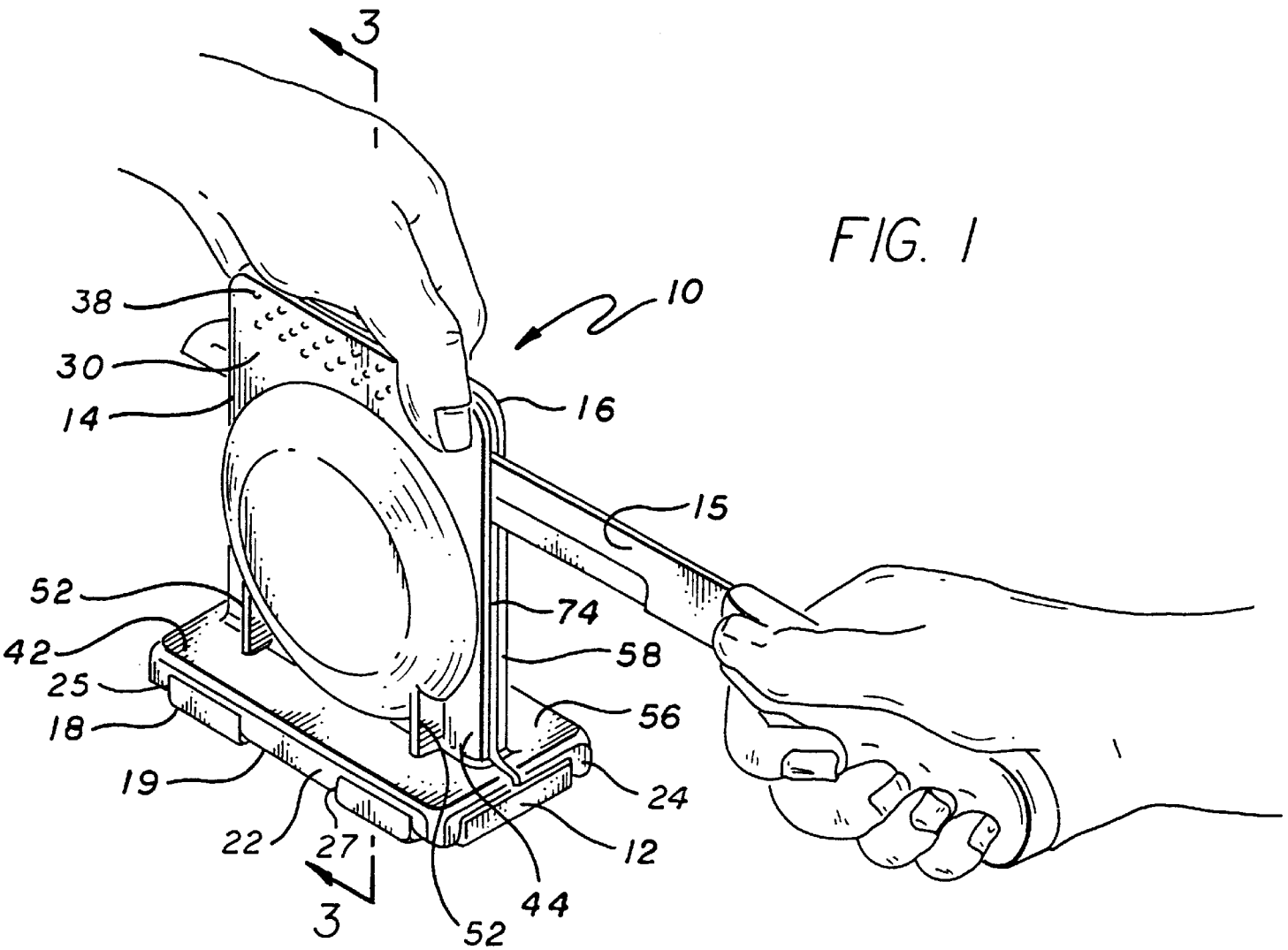
FIG. 1 is a front elevation view of a bagel, roll, and bun holder device according to the present invention.

In the particular embodiment shown in the drawings and herein described, a bagel, roll, and bun holder device 10 is provided. (See FIG. 1, 2, and 3). The bagel, roll, and bun holder device preferably comprises a base element 12 and first and second holding elements 14 and 16, respectively. The base element 12 preferably has a first and a second side portion, 18 and 20, respectively, as shown in FIG. 3. The first and second holding elements, 14 and 16, each preferably have a marginal side portion, 22 and 24, respectively. The first and second holding elements, 14 and 16, also each have an inside surface, 26 and 28, respectively, and an outside surface, 30 and 32, respectively, as shown in FIG. 2 and 3. The first and second holding elements, 14 and 16, each further include a stop element, 34 and 36, respectively, on their inside surface, 26 and 28, and a frictional element, 38 and 40, respectively, as shown in FIG. 3, on their outside surface. The first holding element 14 is pivotally attached to the first side portion 18 of the base element 12, as shown in FIG. 3, at its marginal side portion 22. The second holding clement 16 is pivotally attached to the second side portion 20, as shown in FIG. 3, of the base element 12 at its marginal side portion 24. The first and second holding elements, 14 and 16, are pivotally movable from an opened position to a closed position.

The first holding element 14 comprises a first portion 42 and a second portion 44. (See FIG. 1, 2, 3, 6, and 8). The first portion 42 of the first holding element 14 is substantially perpendicular to its respective second portion 44. Further, the first portion 42 of the first holding element 14 preferably has the side portion 22 and the second portion has the inside surface 26. A depression 50 is formed into the inside surface 26 of the second portion 44 of the first holding element 14, as will be described in more detail later. The marginal side portion 22 of the first holding element 14 is preferably located on the first portion 42 of the first holding element 14. A pair of supporting beams 52 are preferably located on the outside surface 30 of the first holding element 14 to provide support to the first portion 42 of the first holding element 14 and to connect the first portion 42 of the first holding element 14 to the second portion 44 of the first holding element 14. The support provided by the supporting beams 52 prevents the first portion 42 of the first holding element 14 from snapping at its portion below the depression 50.

Similarly, the second holding element 16 comprises a first portion 56 and a second portion 58. (See FIG. 1, 2, 3, 6, and 8). The first portion 56 of the second holding element 16 is substantially perpendicular to its respective second portion 58. The first portion 56 of the second holding element 16 preferably has the marginal side portion 24 and the second portion 58 has the inside surface 28. A depression 68 is formed into the inside surface 28 of the second portion 58 of the second holding element 16, as will be described in more detail later. The marginal side portion 24 of the second holding element 16 is preferably located on the first portion 56 of the second holding element 16. A pair of supporting beams 64 are preferably located on the outside surface 32 of the second holding element 16 to provide support to the second portion 58 of the second holding element 16 and to connect the first portion of the second holding element to the second portion of the second holding element.

In the preferred embodiment of the present invention, the inside surface, 26 and 28, of the first and second holding elements, 14 and 16, each forms a depression, 50 and 68, respectively. (See FIG. 2 and 3). Each depression, 50 and 68, is preferably of such a size and shape so as to receive one half of a bagel, roll, bun, or other item to be sliced 11. The size and shape of each depression, 50 and 68, will therefore depend on the intended use of the bagel, roll, and bun holder device 10 and should be well known to those of ordinary skill in the art. For instance, the bagel, roll, and bun holder device may be intended to hold and slice a bagel 11. (See FIG. 2 and 3). Thus, each depression, 50 and 68, is preferably formed to fit one half of a bagel. The diameter of the depression will preferably be greater than the diameter of an average sized bagel, so that the depression will even fit large or oversized bagels.

The first and second holding elements, 14 and 16, preferably include at least one rib element, 102 and 104, located on the inside surface, 26 and 28, and within the depression, 50 and 68, of each of the first and second holding elements, 14 and 16. (See FIG. 2, 3, and 8). The rib element, 102 and 104, will hold the bagel, roll, bun, or other item within the bagel, roll, and bun holder device 10 when the first and second holding elements, 14 and 16, are in their closed position without piercing or otherwise deforming or defacing the surface of the bagel, roll, bun, or other item 11, while holding it stationary within the bagel, roll, and bun holding device. The rib element, 102 and 104, is preferably a plurality of concentric circular ribs. The concentric circular ribs provides the advantage of being able to engage the bagel, roll, bun, or other item even if it is smaller than the depression of the first and second holding elements.

In the preferred embodiment of the present invention, the first and second holding elements, 14 and 16, include a stop element, 34 and 36, respectively, on their inside surfaces, 26 and 28. (See FIG. 1, 2, 3, and 8). The stop element, 34 and 36, is preferably a protrusion formed on the inside surface, 26 and 28, of each of the holding elements, 14 and 16, that contacts the inside surface, 26 and 28, of the opposite holding element, 14 and 16, when the holding elements are in their closed position. The stop element, 34 and 36, of each holding element, 14 and 16, prevents the inside surfaces, 26 and 28, of the holding elements from contacting each other when the holding elements, 14 and 16, are in their closed position, thereby forming a slot 74 between the inside surfaces, 26 and 28, of the first and second holding elements, 14 and 16, as will be discussed in more detail later. The stop element, 34 and 36, may be any protrusion that provides the function of contacting the inside surface, 26 and 28, of a holding element, 14 and 16, so that the inside surfaces, 26 and 28, of the holding elements, 14 and 16, are not in contact when the holding elements are in their closed position. Any combination of stop elements on the inside surface of either the first or second holding elements, 14 and 16, will suffice so long as the inside surfaces, 26 and 28, of the holding elements, 14 and 16, are not in contact and a slot 74 is formed when the holding elements, 14 and 16, are in their closed position.

As discussed above, the first and second holding elements, 14 and 16, include a frictional element, 38 and 40, respectively, on their outside surface, 30 and 32. (See FIG. 1, 2, 3, and 6). As discussed in more detail below, the user will hold the first and second holding elements, 14 and 16, in their closed position when holding and slicing the bagel, roll, bun or other similar object located within the closed holding elements, 14 and 16. The user will place the tips of his fingers onto the frictional element, 38 and 40, of the outside surface, 30 and 32, of the holding element, 14 and 16, and hold onto the bagel, roll, and bun holder device while slicing the bagel, roll, bun, or other similar object with a knife. The frictional elements, 38 and 40, provide friction so that the tips of the user's fingers will not slip off of the outside surface, 30 and 32, of the holding elements, 14 and 16, when holding the bagel, roll, and bun holder device 10 and slicing the bagel, roll, bun, or other similar object within the device. (See FIG. 1). In one preferred embodiment, the frictional elements, 38 and 40, are a plurality of buttons formed on the outside surface, 30 and 32, of the first and second holding elements, 14 and 16. The frictional element may be any surface that provides suitable friction to the tips of the fingers of the user, as should be well known to those of ordinary skill in the art.

Figure 7:
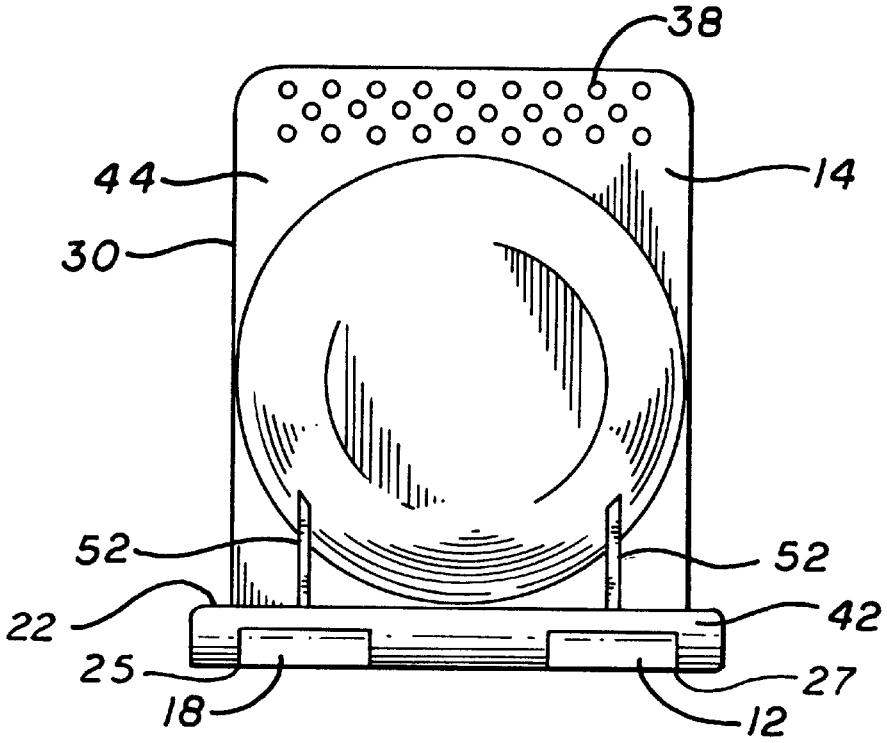
FIG. 7 is a side view showing the holding elements in their closed position.

The base element 12 is a preferably a substantially flat, rectangular piece that has a first side portion 18 and a second side portion 20. (See FIG. 3, 7, and 8). The first and second side portions, 18 and 20, each preferably include slots, 19 and 21, to accept the marginal side portions, 22 and 24, of the holding elements, 14 and 16. The base element 12 preferably has a thick center web 23 the opposite side of which the blade of the knife will contact after slicing the bagel, roll, or bun 11. The thickness of the center web 23 prevents the blade of the knife 15 from slicing through the base element 12 even after a substantial number of uses.

The dimensions of the base clement 12 relative to the other dimensions of the bagel, roll, and bun holder device provide greater stability on a tabletop or countertop when the bagel, roll, and bun holder device 10 is in use. For instance, the distance 110 between the first and second side portions, 18 and 20, of the base element 12 is preferably greater than the largest distance 112 between the outside surfaces, 30 and 32, of the first and second holding elements, 14 and 16, when they are in their closed position. That the base element 12 is wider than the distance 112 between the outside surfaces, 30 and 32, of the holding elements, 14 and 16, in their closed position helps to provide stability and prevent the bagel, roll, and bun holder 10 from falling over or slipping when the user is slicing a bagel, roll, bun, or other similar object within the bagel, roll, and bun holder device 10 on a tabletop or countertop.

In the preferred embodiment of the present invention, the bagel, roll, and bun holder device 10 further includes a first and a second mounting element, 84 and 86, respectively, for mounting the first and second holding elements, 14 and 16, to the base element 12. (See FIG. 3, 4, and 7). The first mounting element 84 connects the marginal side portion 22 of the of the first holding element 14 to the first side portion 18 of the base element 12. The second mounting element 86 connects the marginal side portion 24 of the second holding element 16 to the second side portion 20 of the base element 12.

Figure 8:
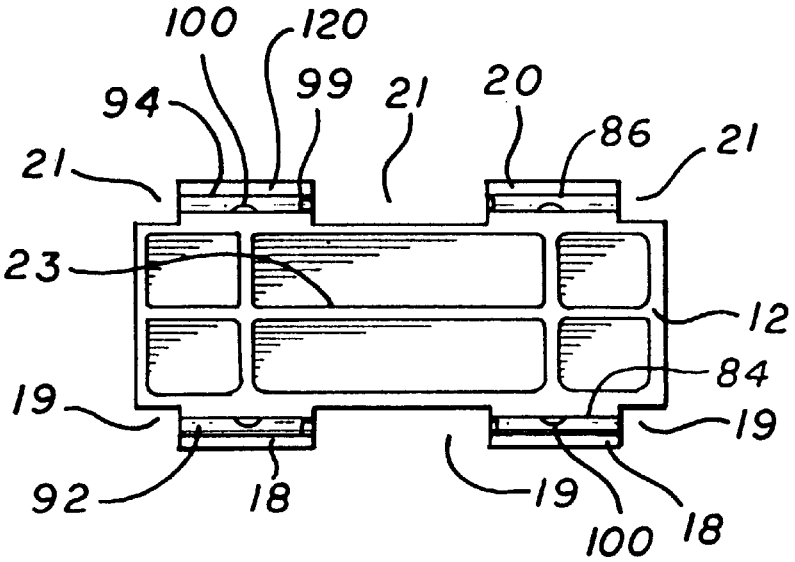
FIG. 8 is a bottom view showing the base element of the bagel, roll, and bun holder device according to the present invention.
Figure 9:
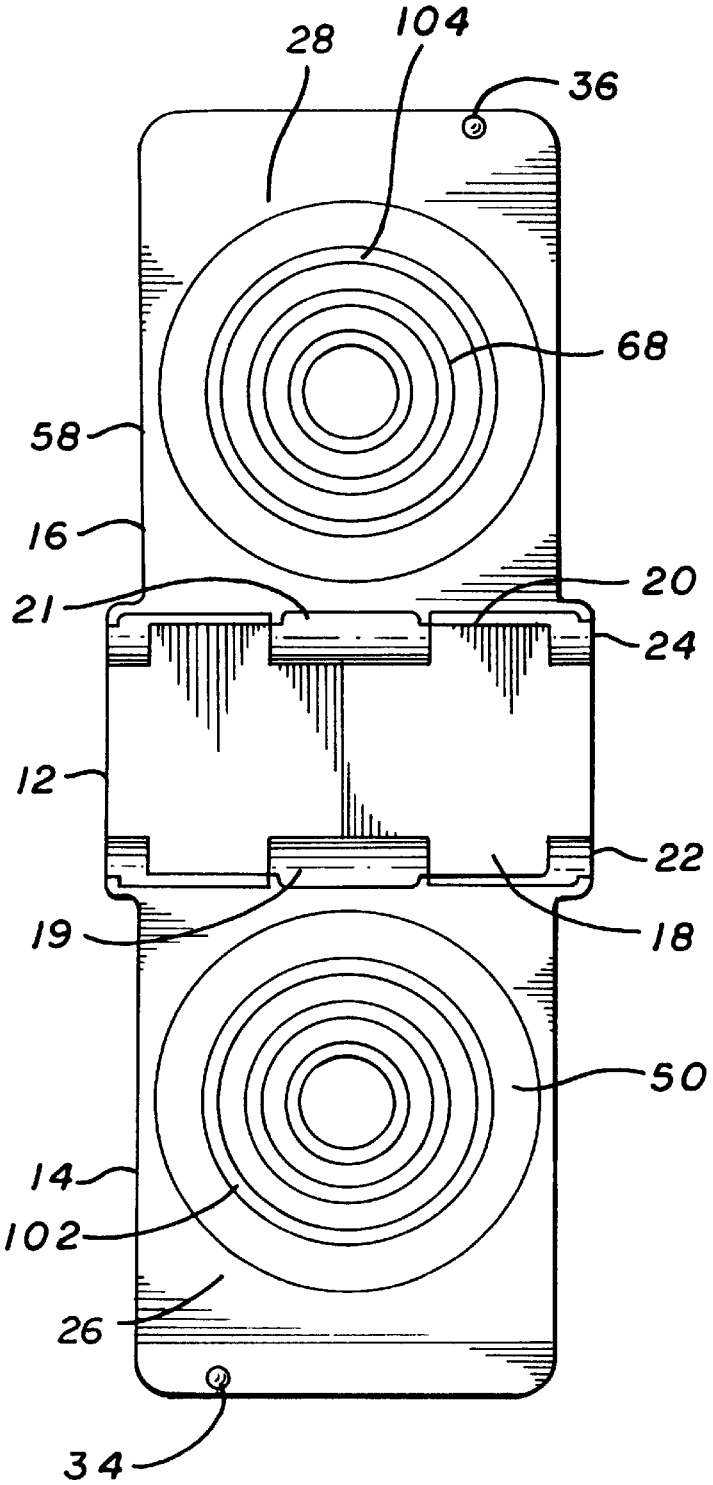
FIG. 9 is a top plan view showing the holding elements in their opened position.
Figure 10:
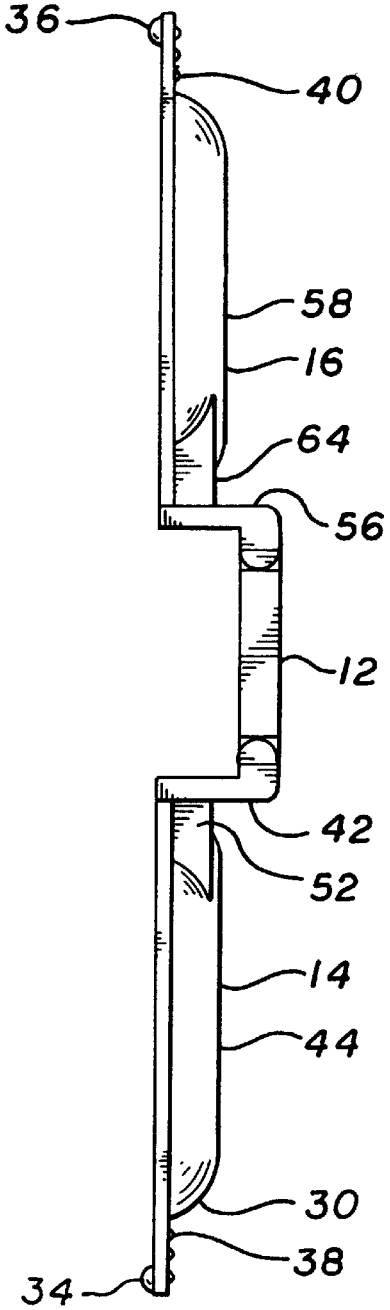
FIG. 10 is a side view showing the holding elements in their opened position.

In the preferred embodiment of the present invention, the first and second mounting elements, 84 and 86, comprise a first and second mounting pivot bar shown in the drawings as 84 and 86, respectively. (See FIG. 3, 4, and 7). The first side portion 18 of the base element 12 comprises a first base element journal sleeve 92, as shown in FIG. 4, 5 and 8, for accepting the first mounting pivot bar 84 and the second side portion 20 of the base element 12 comprises a second base element journal sleeve 94, as shown in FIG. 8, for accepting the second mounting pivot bar 86. The marginal side portion 22 of the first holding element 14 comprises a first holding element journal sleeve 96 for also accepting the first mounting pivot bar 88 and the marginal side portion 24 of the second holding element 16 comprises a second holding element journal sleeve 98 for also accepting the second mounting pivot bar 90. The marginal side portions, 22 and 24, of the holding elements each preferably include a pair of slots, 25 and 27, for accepting the side portions, 18 and 20, of the base element 12. The first and second base element journal sleeves, 92 and 94, each preferably include a detent 100. (See FIG. 3, 4, 5, and 8). The detent 100 permits the first mounting pivot bar 84 to be snapped into the first base element journal sleeve 92 when the first mounting pivot bar 88 is pressed by the user into the first base element journal sleeve 92 and permits the second mounting pivot bar 90 to be snapped into the second base element journal sleeve 94 when the second mounting pivot bar 86 is pressed by the user into the second base element journal sleeve 94.

When the holding elements, 14 and 16, are in their closed position, they are held in their closed position by the placement of ribs 99 on the inside side portions of the base element journal sleeves, 92 and 94, within slot 101, as shown in FIG. 3, of the first and second holding element journal sleeves 96 and 98. (See FIG. 3, 4, 8, and 10.) When the user moves the holding elements, 14 and 16, from their closed position to their open position, the user must apply sufficient outward force to the holding elements, 14 and 16, so that the slot 101 moves over the rib 99. The friction of the rib against the holding element journal sleeves, 96 and 98, is preferably sufficient to maintain the holding element in their open position so that the bagel, roll, bun, or other similar object may be more easily placed within the holding element without the user having to hold both the holding elements in their open position. Thus, the holding element, 14 and 16, may be opened and stabilized to, for instance, 30° angle from center. The user can overcome the friction between the rib 99 and the holding element journal sleeves, 96 and 98, by applying a sufficient inward force to the holding elements, 14 and 16, to force the holding elements, 14 and 16, to their closed position wherein the rib 99 enters the slot 101 thereby maintaining the holding elements, 14 and 16, in their closed position.

In this preferred embodiment of the present invention, the first and second holding elements, 14 and 16, may be removed from the base element 12. The first and second holding elements, 14 and 16, are removed from the base element 12 by removing the first and second mounting pivot bars, 84 and 86, from the first and second base element journal sleeves, 92 and 94, by applying a sufficient force to the first and second mounting pivot bars, 84 and 86, to overcome the detent 100 in the first and second base element journal sleeves, 92 and 94. The user then moves the first and second mounting pivot bars, 84 and 86, beyond the detent 100 and out of the first and second base element journal sleeves, 92 and 94. The first and second holding elements, 14 and 16, are thus removed from the base element 12.

The base element 12, the mounting pivot bars, 84 and 86, and the first and second holding elements, 14 and 16, are preferably formed from molded plastic, which provides the advantage of being easy to manufacture, inexpensive and lightweight. Any plastic or other similar material can be used to form the elements of the bagel, roll, and bun holder device 10, as is well known in the art.

The user preferably holds and slices a bagel, roll, bun or the like as follows. The user first places the base element 12 of the bagel, roll, and bun holder device 10 onto a flat surface such as a tabletop or countertop and pivots the first and second holding elements, 14 and 16, into their opened position. The user can use either their left hand or right hand to pivot the holding elements, because the device is capable of use by both right-handed and left-handed people. The holding elements, 14 and 16, will be held in their opened position by the friction of the rib 99 on the holding elements journal, sleeves 96 and 98. The user then places a bagel, roll, bun, or other similar object 11 into the depression, 50 and 68, of the first or second holding element, 14 and 16, and pivots the first and second holding elements, 14 and 16, to their closed position to lock the rib 99 within slot 101 of the holding element journal sleeves, 96 and 98. One half of the bagel, roll, or bun will be located within the depression 50 of the first holding element 14 and the other half of the bagel, roll, or bun will be located within the depression 68 of the second holding element 16. The rib elements, 102 and 104, on the inside surfaces, 26 and 28, of the first and second holding elements, 14 and 16, within the depression, 50 and 68, will engage both sides of the bagel, roll, bun, or other similar object, thereby holding the bagel, roll, bun, or other similar object stationary in place within the inside surfaces, 26 and 28, of the first and second holding elements, 14 and 16. The stop element 34 on the inside surface 26 of the first holding element 14 will contact the inside surface 28 of the second holding element 16 and the stop element 36 on the inside surface 28 of the second holding element 16 will contact the inside surface 26 of the first holding element 14. The stop elements, 34 and 36, prevent the inside surfaces, 26 and 28, of the holding elements, 14 and 16, from contacting to form a slot 74 between the first and second holding elements, 14 and 16.

When the holding elements, 14 and 16, are in their nearly closed position (5° to 10° open), the user holds the first and second holding elements, 14 and 16, together by placing his fingers on the frictional elements, 38 and 40 (see FIG. 3), located on the outside surfaces, 30 and 32, of the first and second holding elements, 14 and 16. (See FIG. 1). The user then places the blade of a knife 15, held by the user's free hand, within the slot 74 formed between the first and second holding elements, 14 and 16, at the portion of the slot located above the bagel, roll, bun, or other similar object. The user now fully closes holding elements, 14 and 16, to their closed position and slices the bagel, roll, bun, or other similar object. The design of the holding elements, 14 and 16, in their closed position and the base element 12 compels or motivates the user to place the base element on the surface of a flat, horizontal tabletop or countertop to provide greater stability to the device when the user slices the bagel, roll, bun, or other similar object within the device. The user can then slice the bagel, roll, bun, or other similar object 11 down its center portion by contacting the bagel, roll, bun, or other similar object with the sharp edge of the knife 15 and using the knife to slice the bagel, roll, bun, or other similar object 11 while holding the bagel, roll, bun, or other similar object in place within the bagel, roll, and bun holder device. The user can completely slice through the bagel, roll, bun, or other similar object 11 and contact the base element 12 with the knife blade 15 without slicing the base element because the thick center web 23 of the base element 12 prevents the knife blade from slicing through the base elements 12. If the user were to hold the holding elements of the device a little open or off-center, then the user is capable of slicing the bagel, roll, bun, or other similar object held within the device into thirds or some other sized portions. Once the user has completely sliced the bagel, roll, bun, or other similar object as desired, the user will then release his fingers from the frictional elements, 38 and 40, on the outside surface, 30 and 32, of the holding elements, 14 and 16, and pivot the holding elements, 14 and 16, from their closed position to their opened position with sufficient outward force to overcome the friction of the rib 99 and the holding element journal sleeves, 96 and 98. (See FIG. 2, 3, and 4). The user then removes the sliced bagel, roll, bun, or other similar object from the inside surface, 26 and 28, of the first and second holding elements, 14 and 16.

As can be seen from the above description of the preferred embodiments of the present invention, the configuration of the first and second holding elements, 14 and 16, provides a means for holding one half of a bagel, roll, bun or other similar object within each holding element, 14 and 16, in place so that a knife may easily and safely make a clean, straight slice of the bagel, roll, bun or other similar object into two substantially equal halves. The configuration of the holding elements, 14 and 16, also provides a combination, along with base element 12 that is relatively flat when the first and second holding elements, 14 and 16, are moved to their opened position. Because the combination is relatively flat in its opened position, the bagel, roll, and bun holder device 10 may be easily placed, along with dishes and plates, within a dishwasher machine for easy cleaning. Cleaning will be necessary, because bagels, rolls, buns and the like are often prepared with seeds or other substances on their outer surface that will cause the inside surface of the bagel, roll, and bun holder device to become dirty with use. Further, the slicing action of the bagel, roll, and bun within the device will cause crumbs to collect on the base element 12. The configuration of the first and second holding elements also provides a means for holding a bagel, roll, and bun or the like while also providing a slot means for slicing the bagel, roll, and bun in its center.

While a particular form of the invention has been illustrated and described, it will be apparent that various modifications can be made without departing from the scope of the invention. For instance, the frictional element may be a tape having a frictional surface that is applied to the outer surface of the holding elements. Further, the stop element may be a protrusion that extends along substantially the entire width of the inside surface of one of the holding elements or the first holding element may include one or two holding elements on its inside surface and the second holding element may include no holding elements on its surface. The rib element may comprise a series of concentric square ribs, a series of diagonal ribs, or a series of zig-zag ribs, etc. Further, because of symmetry of the device, it is possible to manipulate devices and the manner of closing the holder so that held items could be sliced in other than halves, such as in thirds. Lastly, the device is capable of holding all types of food or other items, and thus may be used to slice fruits and vegetables as well. Accordingly, it is not intended that the invention be limited by the specific embodiment disclosed in the drawings and described in detail hereinabove.

I claim:

1. A bagel, roll, and bun holder device comprising:

a base element having a first and second side portion; and first and second holding elements, wherein the first and the second holding elements each have a side portion, each have an inside surface and an outside surface, each have a stop element protruding from their inside surface, and each have a frictional element on their outside surface, wherein the first holding element is pivotally attached to the first side portion of the base element at the side portion of the first holding element, wherein the second holding element is pivotally attached to the second side portion of the base element at the side portion of the second holding element, and wherein the first and second holding elements are pivotally movable from an opened position to a closed position and wherein, when the first and second holding elements are in their closed position, the stop element of the first holding element contacts the inside surface of the second holding element and the stop element of the second holding element contacts the inside surface of the first holding element thereby forming a slot between the inside surfaces of the first and second holding elements.

2. The bagel, roll, and bun holder device of claim 1 wherein the friction elements on the outside surface of the first and second holding elements comprise a plurality of buttons.

3. The bagel, roll, and bun holder device of claim 1 wherein the first and second holding elements are removably attached to the base element.

4. The bagel, roll, and bun holder device of claim 1 further including first and second mounting elements wherein the first mounting element connects the side portion of the first holding element to the first side portion of the base element and wherein the second mounting element connects the side portion of the second holding element to the second side portion of the base element.

5. The bagel, roll, and bun holder device of claim 4 wherein the first and second mounting elements comprise first and second mounting pivot bars, respectively, and wherein the first side portion of the base element comprises a first base element journal sleeve which accepts the first mounting pivot bar and the side portion of the first holding element comprises a first holding element journal sleeve which accepts the first mounting bar and wherein the second side portion of the base element comprises a second base element journal sleeve which accepts the second mounting pivot bar and the side portion of the second holding element comprises a second holding element journal sleeve which accepts the second mounting bar.

6. The bagel, roll, and bun holder device of claim 5 wherein the first and second base element journal sleeves each further include a detent to allow the first mounting pivot bar to be snapped into and held within the first base element journal sleeve when the first mounting pivot bar is pressed into the first base element journal sleeve and to allow the second mounting pivot bar to be snapped into and held within the second base element journal sleeve when the second mounting pivot bar is pressed into the second base element journal sleeve.

7. The bagel, roll, and bun holder device of claim 1 wherein the base element further includes a center web.

8. The bagel, roll, and bun holder device of claim 1 wherein the first holding element comprises a first portion and a second portion, the first portion being substantially perpendicular to the second portion, and wherein the second holding element comprises a first portion and a second portion, the first portion being substantially perpendicular to the second portion.

9. The bagel, roll, and bun holder device of claim 1 wherein the inside surface of the first and second holding elements each forms a depression.

10. The bagel, roll, and bun holder device of claim 9 wherein, when the first and second holding elements are in their closed position, the distance between the first and second side portions of the base element is greater than the largest distance between the outside surfaces of the first and second holding elements.

11. The bagel, roll, and bun holder device of claim 9 further including at least one rib element located on the inside surface and within the depression of each of the first and second holding elements.

12. The bagel, roll, and bun holder device of claim 11 wherein the rib element is a plurality of concentric circular ribs.

13. A bagel, roll, and bun holder device comprising:

a base element having a first and a second side portion; and first and second holding elements, wherein the first holding element comprises a first portion and a second portion, the first portion being substantially perpendicular to the second portion, the first portion having a side portion, and the second portion having an inside surface that forms a depression, having and an outside surface, having a stop element on its inside surface, having a plurality of concentric circular ribs on its inside surface within the depression, and having a plurality of buttons on its outside surface, wherein the second holding element comprises a first portion and a second portion, the first portion being substantially perpendicular to the second portion, the first portion having a side portion, and the second portion having an inside surface that forms a depression, having an outside surface, having a stop element on its inside surface, having a plurality of concentric circular ribs on its inside surface within the depression, and having a plurality of buttons on its outside surface, wherein the first holding element is pivotally attached to the first side portion of the base element at the side portion of its first portion, and wherein the second holding element is pivotally attached to the second side portion of the base element at the side portion of its first portion, wherein the first and second holding elements are pivotally movable from an opened position to a closed position, and wherein when the first and second holding elements are in their closed position, the stop element of the first holding element contacts the inside surface of the second portion of the second holding element and the stop element of the second holding element contacts the inside surface of the second portion of the first holding element thereby forming a slot between the inside surfaces of the first and second holding elements.

14. The bagel, roll, and bun holder device of claim 13 wherein, when the first and second holding elements are in their closed position, the distance between the first and second side portions of the base element is greater than the largest distance between the outside surfaces of the second portions of each of the first and second holding elements.

15. A method for slicing a bagel, roll, or bun comprising:

providing first and second holding elements pivotally attached to one another and in an opened position, said holding elements each having an inside surface with a depression formed in a portion thereof;

placing the bagel, roll, or bun within the depression formed in the portion of the first and second holding elements;

pivoting the first and second holding elements from their opened position to a closed position so that a stop element on the inside surface of the first holding element contacts the inside surface of the second holding element and so that a stop element on the inside surface of the second holding element contacts the inside surface of the first holding element thereby forming a slot between the first and second holding elements and so that a rib element on the inside surface of each of the first and second holding elements within the respective depression of the first and second holding elements engages the bagel, roll, or bun and holds the bagel, roll, or bun stationary within the first and second holding elements;

holding the first and second holding elements together with the fingers of one hand of a user by placing the fingers on a plurality of frictional elements located on the outside surface of the first and second holding elements;

slicing the bagel, roll, or bun by placing a knife within the slot formed between the first and second holding elements, contacting the bagel, roll, or bun with the sharp edge of the knife, and moving the knife through the bagel, roll, or bun;

releasing the frictional elements of the first and second holding elements;

pivoting the holding elements from their closed position to their opened position; and removing the sliced bagel, roll, or bun from the inside surface of the first and second holding elements.

* * * * *